US011364981B2

(12) United States Patent
Payravi

(10) Patent No.: US 11,364,981 B2
(45) Date of Patent: Jun. 21, 2022

(54) UNDERWATER BREATHING AND MOTION APPARATUS

(71) Applicant: Alireza Payravi, Tehran (IR)

(72) Inventor: Alireza Payravi, Tehran (IR)

( * ) Notice: Subject to any disclaimer, the term of this patent is extended or adjusted under 35 U.S.C. 154(b) by 787 days.

(21) Appl. No.: 16/155,585

(22) Filed: Oct. 9, 2018

(65) Prior Publication Data

US 2019/0308704 A1 Oct. 10, 2019

(51) Int. Cl.
*B63C 11/20* (2006.01)
*B63C 11/22* (2006.01)

(52) U.S. Cl.
CPC ..... *B63C 11/202* (2013.01)

(58) Field of Classification Search
CPC ..... B63C 11/02; B63C 11/14; B63C 11/16; B63C 11/186; B63C 11/20; B63C 11/202; B63C 11/205; A62B 7/02; A62B 7/10; A62B 7/12
USPC ..... 128/201.11, 201.27, 204.18, 204.26, 128/205.12, 205.22, 205.23, 205.24; 405/185, 186
See application file for complete search history.

(56) References Cited

U.S. PATENT DOCUMENTS

| | | | | |
|---|---|---|---|---|
| 2,324,716 | A * | 7/1943 | Max | B63C 11/24 128/201.25 |
| 2,406,888 | A * | 9/1946 | Meidenbauer, Jr. | A62B 7/02 128/205.24 |
| 3,345,984 | A | 10/1967 | Katehis | |
| 3,487,647 | A | 1/1970 | Brecht | |
| 4,752,263 | A | 6/1988 | Pritchard et al. | |
| 4,986,267 | A * | 1/1991 | Doss | B63C 11/202 128/201.27 |
| 5,297,545 | A * | 3/1994 | Infante | B63C 11/202 114/315 |
| 5,947,116 | A | 9/1999 | Gamow et al. | |
| 5,984,739 | A * | 11/1999 | Donahue | |
| 5,996,578 | A * | 12/1999 | MacGregor | A62B 9/00 128/201.27 |
| 6,170,483 | B1 | 1/2001 | Ronjat | |
| 6,565,103 | B2 | 5/2003 | Wilson | |
| 2002/0134387 | A1 | 9/2002 | Saurat et al. | |
| 2019/0367324 | A1 * | 12/2019 | Kim | |

* cited by examiner

*Primary Examiner* — Sunil Singh
(74) *Attorney, Agent, or Firm* — NovoTechIP International PLLC

(57) ABSTRACT

An improved underwater breathing and motion system is disclosed. The improved underwater breathing and motion system may include an air inlet for receiving air from a surface of the water, a system for assisting a diver with motion, and an insulated casing for housing various elements which include an air filtration unit for filtering the air received from the surface, a compressor for compressing the filtered air, a storage unit for storing the compressed air, and a regulator for regulating a pressure of the compressed air when the compressed air is transmitted to a mouthpiece for breathing by a diver.

17 Claims, 5 Drawing Sheets

UNDERWATER BREATHING AND MOTION APPARATUS

TECHNICAL FIELD

The present application relates generally to an underwater breathing and motion apparatus, and more particularly to an apparatus that can transport breathing air from the surface to an underwater diver for an extended period of time without need for cumbersome equipment, while assisting the diver with underwater movement.

BACKGROUND

Underwater swimming with the use of breathing equipment is often referred to as underwater diving. Modern underwater diving has a variety of applications. These include recreation, sport, research and commercial activities, as well as military use. In particular, recreational diving has become popular and widely used in many countries, in recent years, as a pleasant adventure and a source of income in the ecotourism industry.

Underwater diving is generally performed by using two different techniques. One method involves the use of a breathing tank used underwater and is often referred to as scuba diving. The other method utilizes one or more equipment that transfer air from the surface of the water.

Scuba diving tanks contain compressed air which is often heavy. As a result, the dividing tanks are difficult to carry and swim with. Furthermore, these tanks contain a limited amount of air, which limits the amount of time a diver can stay underwater and carry the risk of running out of breathing air while the diver is still underwater.

Transferring air from the surface may be done by transporting compressed air through high pressure and heavy-duty hoses from the surface of the water to the location of the diver underwater. This is often done in military, rescue or scientific research related dives where the diver has to stay underwater for a long period of time. The compressed air may be supplied from the shore, in which case often very long hoses are needed, or it can be supplied from a boat on the surface of the water. This would require one or more operators and extra equipment on the boat.

Therefore, a need exists for providing an improved method and system of enabling a diver to breath comfortably underwater without the need to carry heavy equipment.

SUMMARY

An underwater breathing and motion apparatus is disclosed. In one implementation, the underwater breathing and motion apparatus includes an air inlet floating unit for receiving air from a surface of a body of water, a system for assisting a diver with underwater movement, and an insulated unit for housing one or more air filtration units for filtering the air received from the surface, a compressor for compressing the filtered air, a storage unit for storing the compressed air, and a regulator for regulating a pressure of the compressed air when the compressed air is transmitted to a mouthpiece for breathing by the diver. The insulated unit may be configured to be positioned below the surface of the body of water, when in operation.

A method of providing air to a diver located underwater is disclosed. In one implementation, the method includes receiving air from an air inlet at least a part of which is located above a surface of a body of water, filtering the received air, compressing the filtered air for storage in a storage unit located underwater, regulating a pressure of the compressed air, and providing the regulated pressure air to the diver for breathing through a mouthpiece.

BRIEF DESCRIPTION OF THE DRAWINGS

Features of the subject technology are set forth in the appended claims. However, for purpose of explanation, several implementations of the subject technology are set forth in the following figures.

DETAILED DESCRIPTION

Figure 1:
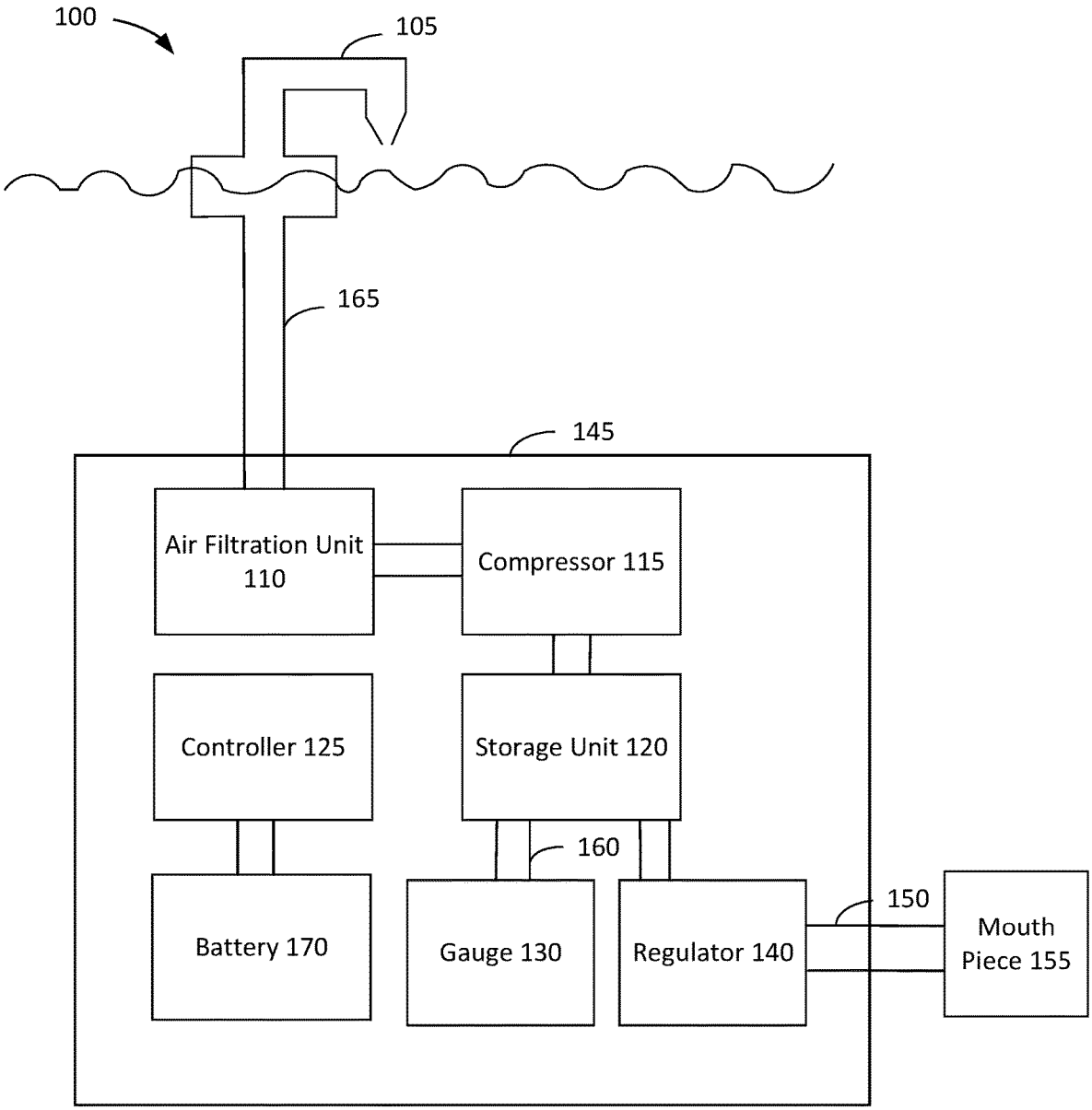
FIG. 1 depicts a block diagram of an improved underwater breathing and motion system.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings. As part of the description, some of this disclosure's drawings represent structures and devices in block diagram form in order to avoid obscuring the invention. In the interest of clarity, not all features of an actual implementation are described in this specification. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

Most currently used underwater breathing equipment are expensive and difficult to operate. For example, scuba diving requires the diver to carry a compressed air tank having a considerable weight which is difficult to move. These tanks also contain a large amount of highly compressed air which carries a risk of dangerous accidents. Moreover, because of the heavy weight of the compressed air, only a limited supply of oxygen can be provided in each tank. This is both dangerous and inconvenient, as the diver has to be cognizant of the amount of oxygen left in their tank or risk being left without breathing air underwater. When the tank is depleted, it has to be refilled by compressors above the surface which are often large in size, expensive to purchase and operate, and detrimental to the environment as they use fossil fuels. Equipment for supplying air directly from the surface to a diver are also expensive and limit a diver's freedom of movement as the diver has to stay connected to heavy-duty air transport hoses.

A technical solution is proposed here to solve these issues and more by providing an improved underwater breathing and motion device that is inexpensive, easy to operate and improves both safety, reliability and comfort of the diver. The improved underwater breathing and motion device can supply the oxygen needed for the diver for a long period of time without needing to refill a tank, is light in weight and thus portable, and provides the diver with the flexibility to freely move around, and remain worry-free as to depletion of the diver's oxygen in deep water. The improved underwater breathing and motion device includes an insulated unit attached to the diver which is connected on one side to above water air inlets through a light and flexible tube and on another side to the diver's mask. The above water air inlets can float on the surface of the water and provide oxygen to the diver directly from the surface. The insulated unit may include a compressor for compressing the atmospheric air, a receptacle for storing the compressed air, one or more filters for purifying the air, and a regulator for regulating the pressure of the air supplied to the diver. The regulator may take into account the depth at which the diver is located to regulate the air pressure. The improved underwater breathing and motion device may also include a motion assistance mechanism to help the diver move easier and faster underwater.

FIG. 1 depicts a block diagram of an improved underwater breathing and motion system 100, in one implementation. The underwater breathing and motion system includes an air inlet floating unit 105 for receiving atmospheric air from the environment, removing moisture from the received air, as discussed below, and transferring the air to an insulated housing 145 for processing and further use through a tube 165. In one implementation, the air inlet floating unit 105 may be connected to a tube made from light and flexible material to transfer the air to the insulated housing 145. The tube may have an adjustable length to allow the diver to travel to different depths. For example, the tube may be compressible such that it can fit into a small compartment on and/or in the insulated housing, but can be automatically pulled out as the diver travels further in depth. Alternatively, the tube may be wrapped around a rod attached to the insulated housing 145 for changing its length.

Figure 2:
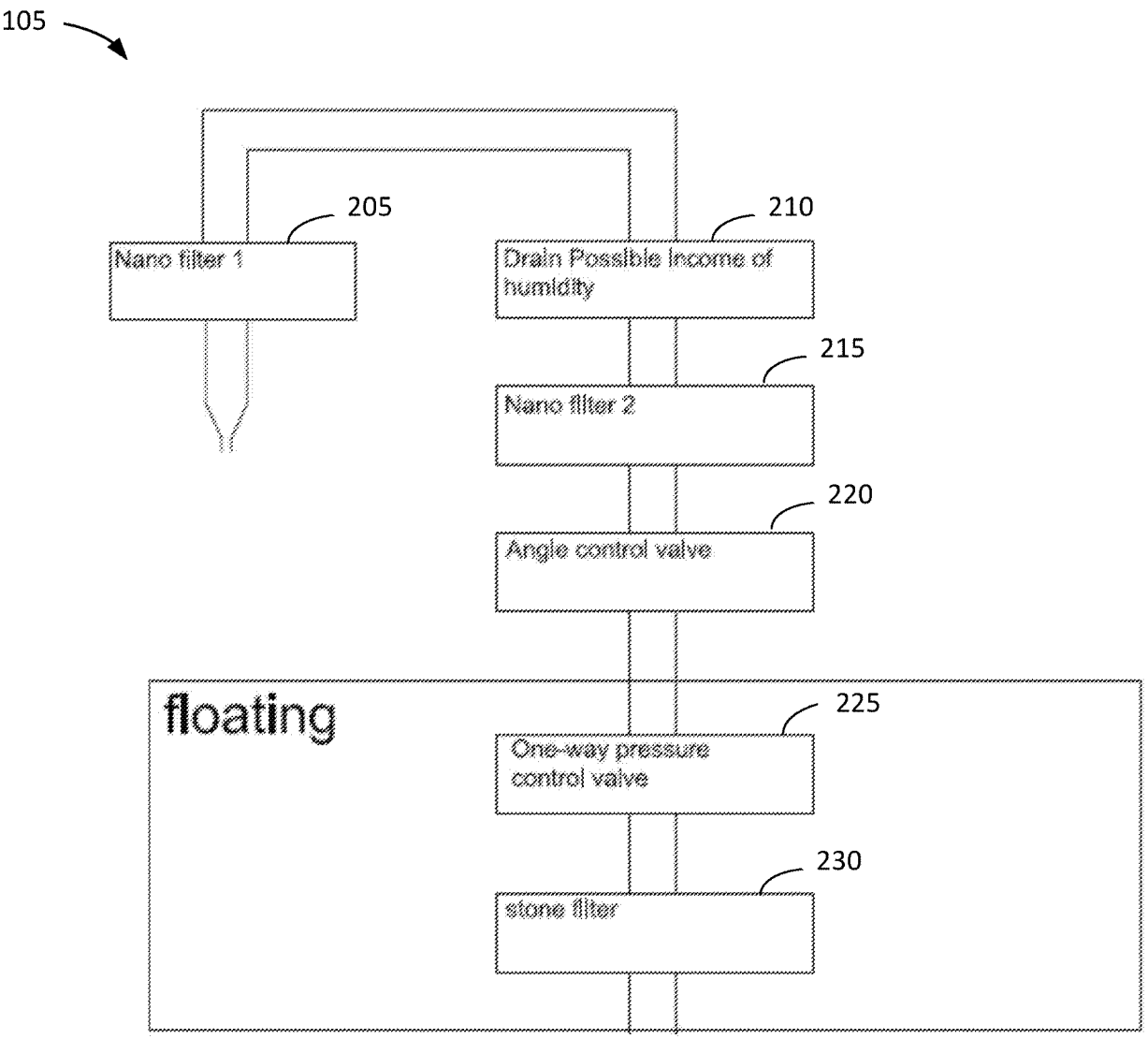
FIG. 2 depicts a block diagram of a floatable air inlet system of the improved underwater breathing and motion system.

FIG. 2 depicts a block diagram of the internal structure of the air inlet floating unit 105. The air inlet floating unit 105 may be made from a light-weight easily movable material that can float on the surface of the water and may extend above the water level by a specific predetermined length such that it provides for easy transfer of air into the insulated housing while preventing water entry into the housing. To achieve this, the air inlet floating unit 105 may include a number of filters such a first Nano filter 205, a second Nano filter 215 and a stone filter 230. These filters may function to remove moisture and other unwanted particles from the air. In one implementation, the entrance to the air inlet floating unit 105 may be shaped like a funnel with a narrow opening in the bottom to prevent water from getting in. Furthermore, the air inlet floating unit 105 may include a housing 210 for removing and temporarily storing any water that entrance the floating unit 105. An angle control valve 220 is used to ensure that the air inlet floating unit 105 stays upright. This is designed in such a way as to ensure the system is only balanced in the vertical direction and any angular movement to one side or another is countered to bring the device back to the vertical position.

The air inlet floating unit 105 may also include a one-way pressure control valve 225 that ensures in cases where the device does move from its upright position temporarily or is covered by a wave, the control valve closes the entrance such that water does not get in.

Referring back to FIG. 1, in order to further ensure that the air entered via the air inlet floating unit 105 is suitable for breathing, the received air is passed through an air filtration unit 110 which may include one or more filters designed to remove moisture and/or other particles from the received air to make it more suitable for breathing. The air filtration unit 110 may be a compact air dehumidifier, which completely absorbs the moisture content of the received air and thus provides clean, dust-free and moisture-free air to the diver. In one implementation, the air filtration unit 110 includes one or more carbon filters.

In addition to the air filtration unit 110, the underwater breathing and motion system includes a compressor 115 which is connected on one side to the air filtration unit 110 and on another side to a storage unit 120. The compressor 115 can receive filtered air from the air filtration unit 110 and compress it before releasing it to the storage unit 120 for temporary storage and/or transfer to the regulator 140. The compressor 115 may be a small air compressing device which is capable of compressing the filtered air up to a pressure of 300 pounds per square inch (psi) (i.e., the air pressure of the compressed air may be above 20 bar). The air outlet transferring the air from the compressor 115 to the storage unit 120 may have a capacity of about 180 liters per minutes (liter/min). This means that the compressor 115 can fill a storage unit having a capacity of about 180 liters in about one minute with air having a pressure of 1 bar. To provide a housing that is small in size and not too heavy to carry and yet provides enough space for temporary storage, the storage unit 120 may have a size that enables it to store sufficient air for a diver to breath while the filtration unit 110 and compressor 115 operate to provide more air. For example, the storage unit 120 may be able to store about 8 liters of air supply at the pressure of approximately 10 bar.

Increasing and decreasing the pressure of the air that enters a diver's lung as it relates to the atmospheric pressure could be very dangerous for the diver. To avoid this danger, the underwater breathing and motion system 100 provides a regulator 140 for regulating the air pressure. To provide a safe and consistent breathing air pressure, the regulator 140 may receive compressed air from the storage unit 120 at a pressure of up to 10 bar and adjust the pressure of the air exiting the regulator to an environmentally appropriate pressure.

In general, the environmentally appropriate pressure of air for breathing changes with atmospheric pressure. Lungs of an average adult have a volume of about 6 to 7 liters. However, a person normally does not need an entire 6 or 7 liters of oxygen for every breath. In general, an average person breathes about 12 times per minute at sea level and needs about 20 liters of air during a minute. Thus, the volume of air required by humans in every breath can be calculated by dividing 20 liters by 12 breaths. This results in approximately 1.6 liters of air. Therefore, a normal person at a pressure of 1 atm at sea level needs about 1.6 liters of air in every breath. This amount changes with the atmospheric pressure. In general, for every one meter of depth in water, about 0.1 of pressure should be added to the atmospheric pressure. Thus, at a depth of about 10 meters, the water has an atmospheric pressure of 1 atm, which when added to the 1 atmospheric pressure at sea level, results in 2 atm. Because of this, the amount of air needed for comfortable breathing underwater is more than the amount needed for breathing at sea level. This amount increases with and is proportional to the depth of water, so that less oxygen is needed in lower depths than what is needed at greater depths. For example, an average adult having lungs with an average volume of 6 to 7 liters, would require about 12 liters of air at a depth of about 10 meters underwater.

As a result, the regulator 140 is used to reduce the pressure of the compressed air exiting the storage unit 120 to an atmospherically appropriate level. The regulator 140 may be a gas pressure regulator having one or more valves in series which reduce pressure and use the downstream pressure as feedback to control the rate of flow and thus the delivered air pressure. In one implementation, the regulator 140 may be connected to a demand valve located in the mouthpiece 155. A demand valve delivers air only when the diver is inhaling and reduces the gas pressure to appropriate ambient pressure. When the regulator 140 is connected to the demand valve, the demand valve may function as a second stage of the regulator 140. Alternatively, the regulator 140 may itself be a single-stage demand valve located in the mouthpiece 155. To connect the regulator to the mouthpiece 155 and/or demand valve in the mouthpiece 155, a hose 150 may be used. The hose 150 may be an inflator hose designed for underwater use.

The storage unit 120 may also be connected to a pressure gauge 130 designed to measure the gas pressure remaining in the storage unit 120. This is to determine when and how often should the compressor operate, as discussed further below. The pressure gauge 130 may be connected to the storage unit 120 through a high-pressure hose 160. In one implementation, the hose 150 may also then be connected to the gauge 130. For example, the gauge 140 may be a submersible pressure gauge located outside of the housing 145 that is connected on one side to the regulator 140 via the high-pressure hose 160 and on the other side to the hose 150. The pressure gauge 130 may be an analog mechanical gauge. Alternatively, the pressure gauge 130 may be a digital computerized sensor designed to measure and monitor air pressure of the storage unit 120.

It should be noted that due to the additional pressure of water on lungs, humans can only breathe normally underwater with an above-surface snorkel at depths of about 20 to 30 centimeters without the use of special equipment. As soon as this depth increases, it is not possible for the diver to inhale air unassisted. This gives the person a feeling of choking. As a result, a mouthpiece 155 is provided to directly insert air into the diver's mouth. The mouthpiece 155 may be a flattened-oval tube that the diver can grip with his/her teeth to make a watertight seal and prevent water from entering. The mouthpiece may be a separate individual piece, or it may be a part of a diving mask that the diver puts on.

The pressure gauge 130 can be used to conserve energy and ensure that the compressor 140 only turns on, when needed. For example, the underwater breathing and motion system 100 may be utilize an automatic pressure control to control the volume and pressure of the compressed air stored in the storage unit 120. This may be done by automatically turning on the compressor 115, when the pressure and/or volume of the compressed air in the storage unit 120 falls below a first threshold and/or automatically turning off the compressor when the pressure and/or volume exceeds a second threshold. For example, system 100 may be set up such that when air pressure inside the storage unit 120 falls below 3 bar, the compressor turns on, while when air pressure reaches 5 bar, the compressor is tuned off. This is done to ensure that power is conserved when sufficient air supply is available. This means, for example, that at sea level with the human air consumption rate of 20 liters per minute, compressor output of 180 liters per minute and storage unit capacity of 8 liters, the system's performance is such that when air is not being provided to a person, it takes approximately 14 seconds for the pressure inside the storage unit 120 to reach 5 bar. Once the system starts being used to provide air to a diver, it takes about 2 seconds for the pressure to drop from 5 bar to 3 bars at which point the compressor is turned on. Then it takes about 45 seconds for the pressure to move up from 3 bar to 5 bar. In other words, in one implementation, when system 100 is in use, the compressor is off for a period of about 20 seconds and then on for a period of about 45 seconds. This significantly extends the battery life of system 100. For example, for the above given statistics, system 100 may be able to operate for about 4.5 hours or more before a need to recharge the battery 170.

In one implementation, system 100's power supply may be provided by the battery 170, which may consist of a rechargeable battery. The battery 120 may be recharged via an outlet on the body of the insulated housing 145 which can be covered when the housing 145 is immersed underwater. The battery 170 may be a dry cell battery, such as a lithium ion battery with a capacity of for example, 100 Ah, 65 Ah, 55 Ah, or 45 Ah. In one implementation, the battery 170 may be recharged via solar energy, or may be rechargeable in a vehicle or at home.

The automatic pressure control to automatically turn the compressor on and off may be performed by the controller 125. In one implementation, the controller 125 includes one or more processors that may operate to control a variety of functions for the underwater breathing and motion system 100. The controller 125 may be connected to or otherwise receive air pressure measurement information from the gauge 130 to control the operation of the compressor 115.

Because of the electrical devices included in the housing 145, it is important that the housing 145 be completely insulated (i.e., waterproof) and susceptible to high underwater pressure such that no water can penetrate the housing. As a result, the housing 145 is insulated and made from a material that can withstand water pressure. The housing 145 may also include a mechanism by which it can be opened to provide access to the components inside. In one implementation, the housing 155 mays also include an on and off button (not shown) for switching the system 100 on and off and a safety valve to ensure that all safety requirements are met.

Figure 3:
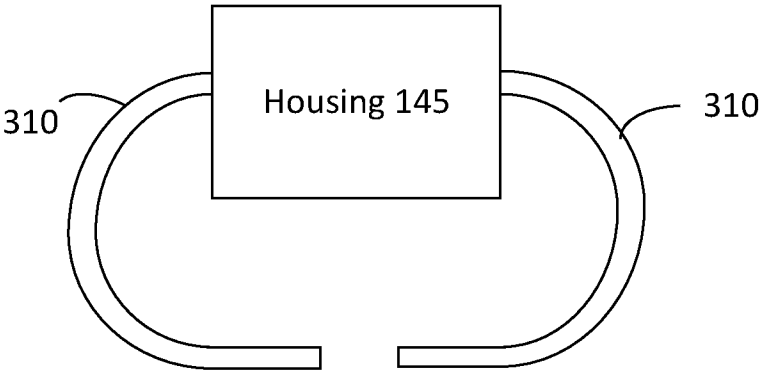
FIG. 3 depicts a block diagram of a mechanism by which a housing unit of the improved underwater breathing and motion can be attached to a diver.

To provide for easy transportation, the insulated housing 145 may be connected to one or more straps that can be then be attached to the diver. This is illustrated in FIG. 3, where housing 145 is attached to straps 310. The straps 310 may form a belt that can be positioned around the diver's waist for easy transport. Alternatively, the straps 310 may be used to attach position the housing 145 on a diver's back. For example, the straps 310 may function similarly to straps of a backpack. In yet another alternative, the housing 145 may be placed inside a diving backpack that can carry other equipment for the diver.

Objects in water are divided into 3 categories: those that sink and have a negative buoyancy, those that float which have a positive buoyancy, and those objects that become submerged in the middle of the water and have neutral buoyancy. In general, buoyancy is related to the weight of each object and the volume of the water it displaces when it moves. For example, a large ship is lighter in weight than the amount of water it displaces. As a result, it has positive buoyancy and thus floats on the water. In contrast, the weight of a coin is larger than the amount of water it moves. As a result, the coin sinks. Based on these principles, a diver carrying the underwater breathing and motion system may still have a small amount of positive buoyancy. This can be eliminated by applying weights. For example, the housing 145 may be attached to one or more weighted elements designed to add weight to the diver as needed. Alternatively, a weight belt may be worn by the diver to achieve a neutral buoyancy that allows the diver to be submerged underwater without sinking.

Figure 4:
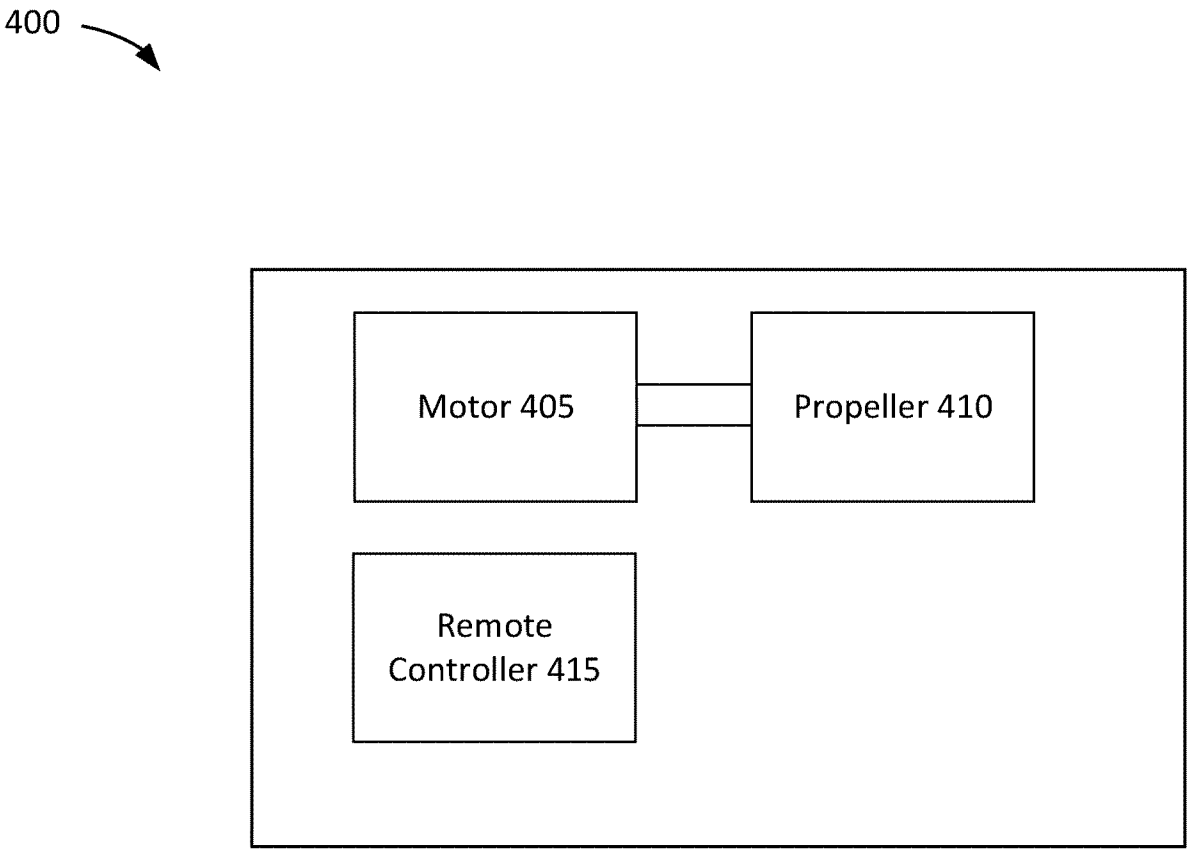
FIG. 4 depicts a block diagram of a system for assisting the diver with underwater movement.

In addition to provide improved underwater breathing, the improved underwater breathing and motion system disclosed herein, may also include a mechanism for assisting the diver with underwater movement. FIG. 4 depicts a block diagram for such a mechanism. The device 400 for improving the movement of the diver underwater may include a motor 405 attached to a propeller 410. The motor 405 may be positioned inside an insulated waterproof housing and may be a DC motor with enough power to spin the blades of the propeller 410 underwater. The angles of the blades may be specifically designed for underwater movement. The motor 405 may be supplied power through the same battery (i.e., battery 170 of system 100) and does not affect the performance of the breathing system 100 because of its very low power consumption. Alternatively, the device 400 may include its own source of power which may be an internal rechargeable battery. In an alternative implementation, the device 400 may use the flow of the diver's breathing air to move the propeller 410 thus obviating the need for the motor 405.

The system 400 may positioned on a diver's back while in use. In one implementation, a remote controller 415 may be used to operate the system 400 and/or system 100. For example, the controller 415 may be able to switch the system 400 on and off, and/or control the speed with which the motor 405 operates. The remote controller may be connected to the system wirelessly and may be a small waterproof unit that can be carried in the diver's hand and/or pocket. By turning the system 400 on and controlling the speed of the motor (which in turn controls the speed with which the blades of the propeller 410 spin), the diver can change the speed by which he/she moves underwater. By using the system 400, the diver can move easier and faster underwater. This is particularly useful in military diving operations, as not only adds speed to a diver's movement, it also frees their hands to perform any operation needed.

Figure 5:
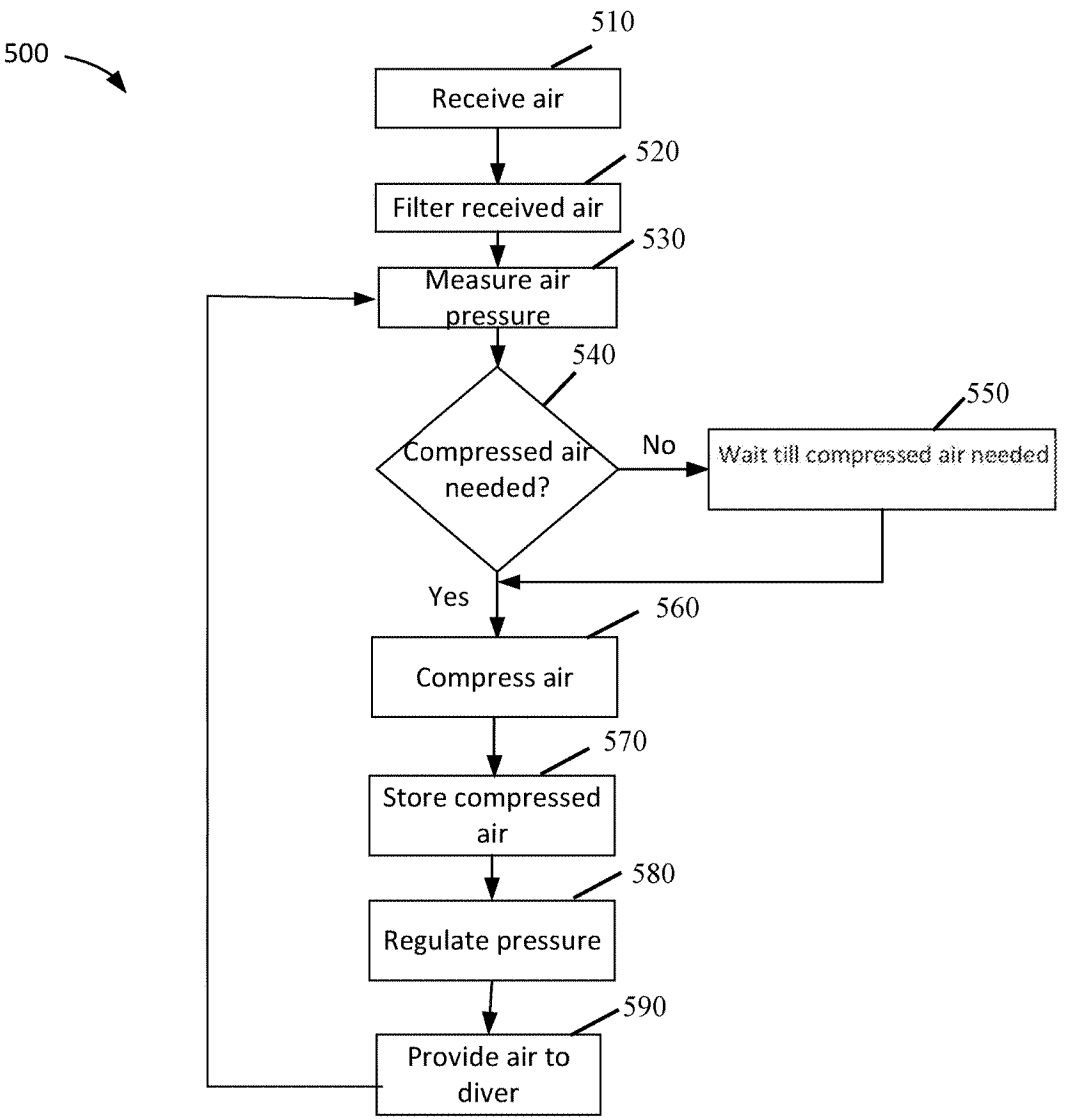
FIG. 5 is a flow diagram for a method of providing air to an underwater diver.

FIG. 5 is a flow diagram depicting an exemplary method 500 for providing air to an underwater diver. At 510, method 500 begins by receiving air from above the surface of the water. This may be done, by for example, receiving air from an air inlet such as the one shown in FIG. 1. The received air is then filtered, at 520, to remove moisture and/or any other unwanted particles in the air. Method 500 then proceeds to measure, at 530, the pressure of air in an air storage unit, before determining, at 540, whether compressed air is needed for the system. This may be done, by determining if the measured air pressure in the air storage unit is below a required threshold. When it is determined that the air pressure is above the required threshold, method 500 proceeds to wait, at 550, until it is determined that compressed air is needed, at which point, the method proceeds to compress the filtered air, at 560. Compressing the filtered air may also occur when it is determined, at 540, that compressed air is needed.

The compressed air is then stored, at 570, in the storage unit provided for temporary storage of compressed air. Subsequently, the stored compressed air is processed via a regulator to regulate its pressure, at 580. This may involve reducing the compressed air pressure to bring it to a pressure appropriate for breathing underwater. Once the air pressure is regulated, air is provided to the diver, at 590. Method 500 then returns to measure the air pressure at 530 to determine if more compressed air is needed before repeating the same steps.

In one implementation, when it is determined, at 540, that compressed air is not needed, the compressor compressing the air is turned off until compressed air is needed, at which point the compressor is turned back on. In one implementation, method 500 also includes the steps of turning on a motor for operating a propeller intended to assist the diver in moving underwater and controlling the speed of the propeller.

Thus, the improved underwater breathing and motion device and method can be used to provide breathing air to a diver without the needed to refill an air tank and without the need for cumbersome tubes connected to a compressor above the water. This device can be used for recreational, military, scientific research, and industrial diving, such as underwater welding or operations on dredged ships or even supplying oxygen needed for fuel cells in submarines. This device also has the ability to provide breathing air to one or more divers at depths of up to 40 miters, while it can also help the divers move faster and easier underwater.

The separation of various components in the examples described above should not be understood as requiring such separation in all examples, and it should be understood that the described components and systems can generally be integrated together in a single packaged into multiple systems.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

What is claimed is:

1. An underwater breathing and motion apparatus comprising:

a floating air inlet unit for receiving air from a surface of a body of water;

the floating air inlet unit includes a nano filter and a stone filter;

a system for assisting a diver with underwater movement;

an insulated unit for housing;

one or more air filtration units for filtering the air received from the surface;

a compressor for compressing the filtered air;

a storage unit for storing the compressed air; and a pressure gauge positioned outside the storage unit and connected via a high-pressure hose to the storage unit, the pressure gauge being configured for measuring a pressure of the compressed air stored in the storage unit;

a controller connected to the pressure gauge for receiving air pressure measurements from the pressure gauge and controlling an operation of the compressor;

a regulator for regulating a pressure of the compressed air when the compressed air is transmitted to a mouthpiece for breathing by the diver, wherein:

the one or more air filtration units are connected on one side of the one or more air filtration units to the floating air inlet unit and are connected on a different side of the one or more air filtration units to the compressor, and the insulated unit is configured to be positioned below the surface of the body of water, when in operation.

2. The underwater breathing and motion apparatus of claim 1, further comprising a battery for supplying power to the compressor.

3. The underwater breathing and motion apparatus of claim 1, wherein the insulated unit is waterproof to prevent water from entering into the insulated unit.

4. The underwater breathing and motion apparatus of claim 1, further comprising a diving mask, wherein the mouthpiece is positioned on the diving mask.

5. The underwater breathing and motion apparatus of claim 1, wherein the insulated housing is connected to one or more straps for attaching the insulated housing to the diver.

6. The underwater breathing and motion apparatus of claim 5, wherein the one or more straps function as a belt such that the insulated housing can be carried on a diver's body.

7. The underwater breathing and motion apparatus of claim 1, wherein the system for assisting the diver with underwater movement comprises a motor connected to a propeller for assisting the diver move underwater.

8. The underwater breathing and motion apparatus of claim 7, wherein the propeller assists the diver move faster underwater.

9. The underwater breathing and motion apparatus of claim 1, further comprising a remote control system for controlling the operation of the underwater breathing and motion apparatus.

10. The underwater breathing and motion apparatus of claim 1, wherein the nano filter includes a first nano filter and a second nano filter.

11. A method of providing air to a diver located underwater, the method comprising:

receiving air from an air inlet unit at least a part of which is located above a surface of a body of water;

filtering the received air via a nano filter and a stone filter, and via one or more air filtration units connected on one side of the one or more air filtration units to the air inlet unit and on a different side of the one or more air filtration units to a compressor;

compressing the filtered air via the compressor for storage in a storage unit located underwater;

controlling an operation of the compressor via a controller connected to a pressure gauge;

measuring a pressure of the compressed air stored in the storage unit via the pressure gauge, the pressure gauge positioned outside the storage unit and connected via a high-pressure hose to the storage unit;

regulating a pressure of the compressed air; and providing the regulated pressure air to the diver for breathing through a mouthpiece.

12. The method of providing air of claim 11, further comprising measuring the pressure of air stored in the storage unit and determining based on the measured pressure if compressed air is needed before compressing the filtered air.

13. The method of providing air of claim 12, wherein determining if compressed air is needed is done by determining if the measured pressure meets a threshold.

14. The method of providing air of claim 13, further comprising turning a compressor that compresses the filtered air off upon determining that the measured pressure does not meet the threshold.

15. The method of providing air of claim 14, further comprising turning the compressor on upon determining that the measured pressure meets the threshold.

16. The method of providing air of claim 14, further comprising providing power to the compressor via a battery.

17. The method of providing air of claim 11, further comprising assisting the diver move underwater by turning a propeller attached to the diver on.

* * * * *